United States Patent [19]

Corth

[11] 4,032,809

[45] June 28, 1977

[54] TANTALUM CARBIDE OR TANTALUM-ALLOY CARBIDE FILAMENT MOUNTING AND METHOD

[75] Inventor: Richard Corth, East Orange, N.J.

[73] Assignee: Westinghouse Electric Corporation, Pittsburgh, Pa.

[22] Filed: Mar. 21, 1966

[21] Appl. No.: 535,835

[52] U.S. Cl. ..... 313/344; 313/218; 313/272; 313/276; 313/311; 313/316; 313/315; 313/331

[51] Int. Cl.[2] ..... H01J 1/16; H01J 19/06; H01K 1/04; H01J 1/88

[58] Field of Search ..... 313/115, 217, 218, 271, 313/272, 273, 279, 311, 315, 316, 331, 332, 333, 344, 355

[56] References Cited

UNITED STATES PATENTS

| | | | |
|---|---|---|---|
| 1,637,034 | 7/1927 | Bergmans | 313/344 X |
| 2,434,478 | 1/1948 | Allen | 313/333 X |
| 2,987,643 | 6/1961 | Ackerman | 313/315 |
| 3,022,437 | 2/1962 | Cooper | 313/218 |
| 3,183,395 | 5/1965 | Rively et al. | 313/272 X |
| 3,237,284 | 3/1966 | Bird | 313/315 |
| 3,287,591 | 11/1966 | Sloan | 313/331 X |

*Primary Examiner*—Andrew J. James
*Attorney, Agent, or Firm*—W. D. Palmer

[57] ABSTRACT

Coiled incandescible filament which principally comprises tantalum carbide has coiled end portions thereof overfitting relatively thick tantalum carbide members, with the inner surfaces of the overfitting coils welded to the relatively thick members. Electrical connection and support for the filament is made to the relatively thick, overfitted members, rather than the fine, brittle filament. In order to effect the weld between the overfitting coils and the relatively thick members, the coils and relatively thick members are first overfitted as metals and then carbided, with diffusion welds therebetween formed during the carbiding process.

6 Claims, 6 Drawing Figures

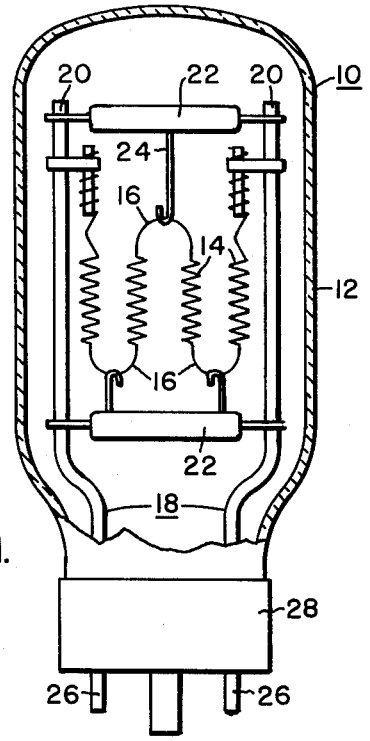

FIG. 1.

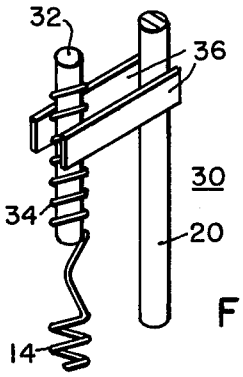

FIG. 2.

FORM AN ELONGATED FILAMENTARY COIL PRINCIPALLY COMPRISING TANTALUM

↓

FIT A COILED END EXTENSION OF THE COIL ABOUT A RELATIVELY THICK ELONGATED MEMBER PRINCIPALLY COMPRISING TANTALUM

↓

HEAT SAID COIL AND SAID RELATIVELY THICK MEMBER IN A CARBON-CONTAINING ATMOSPHERE TO CONVERT THE COIL TO TANTALUM CARBIDE AND EFFECT A DIFFUSION WELD BETWEEN SAID RELATIVELY THICK MEMBER AND THE OVERFITTING COIL TURNS.

FIG. 3.

WITNESSES:

Leon M. Garman

James F. Young

INVENTOR

Richard Corth

BY

W. D. Palmer

ATTORNEY

TANTALUM CARBIDE OR TANTALUM-ALLOY CARBIDE FILAMENT MOUNTING AND METHOD

This invention generally relates to tantalum carbide filaments and, more particularly, to a tantalum carbide or tantalum-alloy carbide filament mount and to a lamp incorporating such mount, as well as a method for making the mount.

Tantalum carbide and tantalum-alloy carbide filaments for incandescent lamps are known in the art. When operated in a suitable gaseous atmosphere comprising hydrogen, halogen and carbon, for example, such filaments can be operated at a very high temperature, such as from 3300° K to 3700° K. This operating temperature range is near and exceeds the melting point of tungsten per se (3643° K.) and is far above the normal operating temperature of tungsten filaments. This makes a tantalum carbide or tantalum-alloy carbide filament particularly useful in applications such as projection lamps where it is desirable to operate the lamp in as bright a manner as possible commensurate with even a relatively short life.

One of the drawbacks which prevents commercial use of tantalum carbide filaments is the difficulty encountered in mounting the fabricated filament. Tantalum carbide and tantalum-alloy carbide filaments are extremely brittle and if the thin filament is clamped by lead-in supports, there is a tendency to break the filament. In addition, a very thin tantalum carbide filament is quite difficult to weld to a supporting member, since a loss of carbon will normally occur at the junction of the weld and the filament tends to shatter during welding. Also, if a thin tantalum carbide filament is intimately connected to a metallic support member, either by clamping or by welding, a loss of carbon will occur during lamp operation at the junction of the filament and the metal lead-in support, due to diffusion of carbon into the metal lead-in support. The resulting change in composition of the filament near the lead-in support is deleterious to the life of the filament. It has been the practice to mount the filament in the completed lamp as a metallic filament, which is thereafter converted to tantalum carbide. From a commercial standpoint, this is impractical.

It is the general object of this invention to provide a combination connection for mechanically supporting and electrically connecting a tantalum carbide filament to a main filament support.

It is another object to provide a lamp which incorporates a tantalum carbide filament which is connected to a main supporting frame by means of an improved filament support and connection.

It is a further object to provide a method for securing a tantalum carbide filament to a relatively heavy member for purposes of support and electrical connection.

It is an additional object to provide a method for forming a tantalum carbide or tantalum-alloy carbide filament and the connecting support therefor prior to incorporation into a lamp.

The foregoing objects of the invention, and other objects which will become apparent as the description proceeds, are achieved by providing a combination connection for mechanically supporting and electrically connecting a coiled, elongated, incandescible filament principally comprising tantalum carbide to a main filament support and electrical connection means. The connection comprises a relatively thick, elongated member which principally comprises tantalum carbide. A coiled end extension of the elongated filament coil snugly overfits at least a part of the relatively thick, elongated tantalum carbide member, and the inner surface of the overfitted turns of the coiled end extension are welded to the relatively thick, elongated member. This latter member in turn is electrically connected to and mechanically supported by the main filament support and electrical connection means, such as the supporting frame. In forming the filament support, an elongated filamentary coil, which principally comprises tantalum metal, is provided with a coiled end extension and this end extension is fitted over in snug contacting relationship with at least a part of a relatively thick, elongated member principally comprising tantalum metal. The coil and the relatively thick, elongated member are then heated at a predetermined temperature and for a predetermined time in an atmosphere consisting essentially of carbon as the only reactive constituent to convert tantalum metal of both the coil and the thick member to tantalum carbide. During this conversion from metal to carbide, a diffusion weld is effected between the contacting surfaces of the filament coiled end extension and the relatively thick, elongated member. Since this latter member has a substantial mass, electrical connection and support can readily be made thereto.

For a better understanding of the invention, reference should be made to the accompanying drawings, wherein:

FIG. 1 is an elevational view, shown partly in section, of a projection lamp which incorporates the combination connection of the present invention;

FIG. 2 is an enlarged, fragmentary, isometric view showing details of the combination connection of the present invention;

FIG. 3 is a flow diagram showing the basic steps of the present method;

Figure 4:
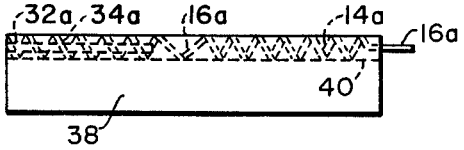
FIG. 4 is an elevational view showing a metallic filament and metallic filament support and connection in position on a carbon supporting member, prior to making the connection of the present invention.

With specific reference to the form of the invention as shown in the drawings, the projection lamp 10 of FIG. 1 comprises a sealed envelope 12, at least a portion of which is radiation transmitting. The filament 14 is formed as a multi-barrel filament having four coils, with each barrel of the filament connected by an uncoiled portion 16. Preferably the coiled filament 14 is formed of tantalumtungsten carbide wherein ratio by weight of tantalum to tungsten is 90–10. Other tantalum-containing alloys could be used such as described in U.S. Pat. No. 3,219,493, dated Nov. 23, 1965, wherein the tantalum metal is present in a major percentage. Alternatively, the filament 14 can be formed of stoichiometric tantalum carbide.

The envelope 12 encloses an atmosphere suitable to support operation of a tantalum carbide filament and such atmospheres are well known in the art, an example comprising an atmosphere of halogen, hydrogen and carbon.

A supporting frame structure 18, which constitutes a main filament support and electrical conduction means, is rigidly affixed within the envelope 12. This frame comprises two relatively rigid tantalum lead-in members 20 having supporting glass canes 22 affixed therebetween. For a multibarrel filament such as shown, support wires 24 are affixed to the glass canes 22 and contact the uncoiled filament portions 16 which connect the individual filament barrels. The rigid tantalum lead-in and support memebers 20 are electrically connected to base pins 26 which project from the base 28 of the lamp 10 to facilitate electrical connection.

In accordance with the present invention, electrical connection is made between the filament 14 and the main filament support and electrical connection frame 18 by a combination connector 30, as shown in more detail in FIG. 2. This combination connector 30 comprises a relatively thick, elongated member 32 which snugly fits inside a coiled end extension 34 of the elongated filament coil 14. The inner surface of the overfitted turns of the end extension coil 34 are welded to the relatively thick member 32.

In the embodiment as shown, the elongated member 32 is affixed to the main filament support by means of a mechanical connection which is made by welding two tantalum strips 36 to the tantalum support member 20 and the extending ends of the tantalum metal members 36 mechanically hold the overwound member 32 therebetween. The two tantalum strips 36 could be replaced by a single wrapped member, if desired. Alternatively, since the member 32 is relatively heavy, it could be welded directly to the tantalum rod 20, if desired, thereby eliminating the mechanical connection.

In the preferred embodiment as shown, the coiled elongated filament 14 has two end extension portions 34 and each of these end extension portions snugly overfits at least a part of a different one of the relatively thick, elongated members 32, which in turn are electrically connected to and are mechanically supported by the main filament support and electrical connection means 18. It should be understood that only one of these connection members 30 could be used, if desired, and the other end of the filament 14 connected by a more conventional means.

Figure 5:
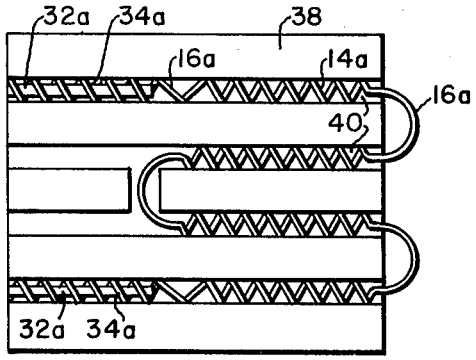
FIG. 5 is an elevational view of FIG. 4.

In making the weld between the filament coiled end extension 34 and the relatively thick member 32, as outlined in the flow diagram of FIG. 3, the filament coil is first conventinally formed of tantalum metal or any of the indicated tantalum-containing alloys as specified hereinbefore. As shown in FIGS. 4 and 5, the metallic coiled filament **14*a* is provided with a coiled end extension or extensions 34*a*, which may or may not be separated from the main filament coil by an uncoiled section 16*a*, depending upon the application for the filament. The coiled end extension 34*a* of the filament coil is fitted over and in snug contacting relationship with at least a part of the relatively thick, elongated metallic member 32*a*, which principally comprises the tantalum metal or a tantalum-containing alloy, with a metallic alloy of 90% tantalum--10% tungsten by weight being preferred. The metallic coil and the relatively thick metallic member are then heated at a predetermined temperature and for a predetermined time in an atmosphere consisting essentially of carbon as the only reactive constituent to convert tantalum metal of both the coil and the relatively thick elongated member to tantalum carbide. During this conversion from metal to carbide, a diffusion weld is effected between the contacting surfaces of the coiled end extension 34 and the relatively thick elongated member 32. Even though the carbide member 32 is quite brittle because of its composition, its relatively large mass enables it to be easily clamped or otherwise affixed to the main filaments support and electrical connection 18**.

Figure 6:
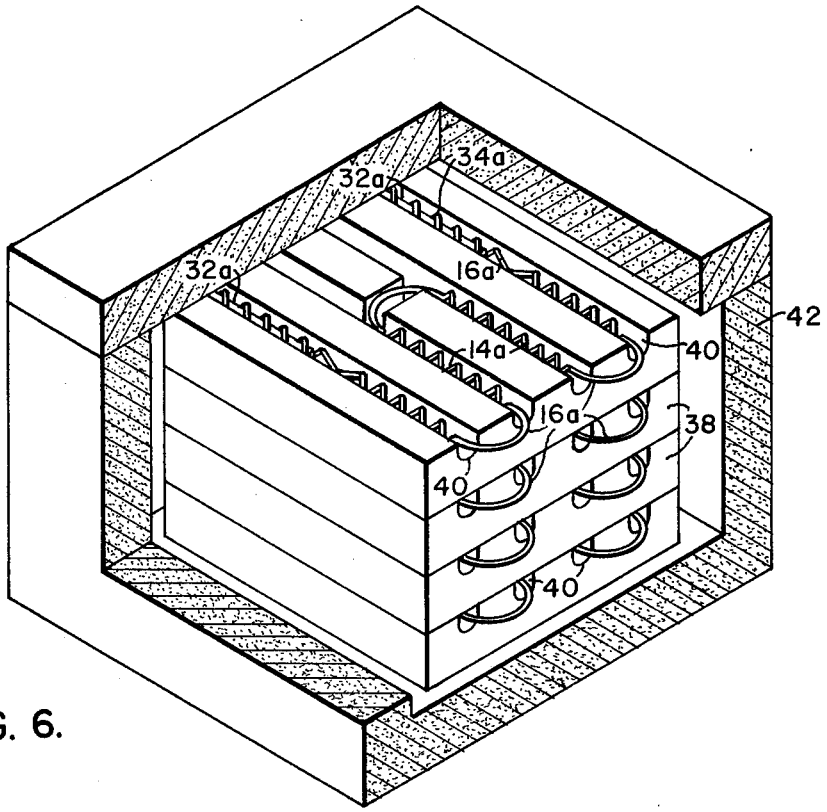
FIG. 6 is an isometric view, partly broken away, showing the carbiding step wherein the filament is diffusion welded to the relatively thick member.

The preferred method for converting the tantalum or tantalum-containing alloy to tantalum carbide or tantalum-alloy carbide is disclosed in detail in copending application Ser. No. 535,815, filed concurrently herewith, entitled "Method For Producing Tantalum Carbide And Tantalum-Alloy Carbide Filaments" by the present inventor and assigned to the present assignee. As a specific example, and as shown in FIGS. 4 and 5, the coiled metallic filament **14*a*, before carbiding, together with the coiled end extensions 34*a* before overfit the elongated metallic members 32*a*, are all placed on a carbon support member, such as a graphite slab 38, which has receiving grooves 40 provided in the top surface thereof in order to receive and support the metallic filament 14*a* and support members 32*a*. In the preferred method for effecting the connection and carbiding the filament, a plurality of the graphite slabs 38 are nestled on top of one another as shown in FIG. 6, and the entire assembly placed into a carbon crucible 42. The carbon crucible 42 is then placed into an induction-or-elecrically heated furnace which has a controlled atmosphere of either a vacuum or inert gas such as argon. Preferably, the metallic filament 14*a* is first stress relieved by heating to a temperature of 1500° C. for 15 minutes. Thereafter, the temperature is raised to heat the support member 38 and the supported metallic coil 14*a* and relatively thick elongated metallic member 32*a* in an atmosphere consisting esentially of carbon as the only reactive constituent at a predetermined temperature below the eutectic melting temperature of tantalum-carbon, but sufficient to cause carbon to readily diffuse into the coil 14*a* and the elongated support member 32*a*. This initial heating is maintained for a sufficient time to diffuse sufficient carbon into the metallic coil 14*a* and metallic support and connection member 32*a* so that the diffused carbon substantially exceeds that carbon content required to form a tantalum-carbon eutectic. As a specific example, the initial heating is conducted at a temperature of from 2600° C. to 2650° C. for a period of 30** minutes and the melting temperature of the initially heated filament is more than 3100° C.

In the next step of the processing, the support member 38 along with the supported coil **14*a* and relative thick member 32*a* are heated in the same atmosphere to a final heating temperature greater than the tantalum-carbon eutectic melting temperatue, but less than the melting temperature of the now partially carbided coil and the relatively thick support member. This final heating temperature is maintained for a predetermined period of time to cause additional carbon to diffuse into the members being carbided to form stoichiometric tantalum carbide. As a specific example, the final heating is conducted at a temperature of more than 3000° C., such as 3100° C, for a period of about 30 minutes. Thereafter, the now completely carbided members are cooled under non-reactive conditions to a temperature below which the filament 14 will not oxidize, such as about 100° C. The completely carbided filament coiled end extension 34 and associated thick support member 32 are welded together by diffusion welding which occurs during the carbiding. The filament can now be mounted into the projection lamp 10, in the manner as shown in FIG. 1**.

It will be recognized that the objects of the invention have been achieved by providing a combination connection for mechanically supporting and electrically connecting a coiled tantalum carbide filament to a main filament support and electrical connection. This combination connection can be used in conjunction with a projection or similar lamp. there has also been provided a method for making the improved combination connection, which is made prior to incorporating the filament into the lamp.

While projection lamps have been considered in detail hereinbefore, it should be understood that the present combination connection can be used with any type of lamp which is desired to operate at a high temperature and brightness, such as photoflood lamps or sealed-beam head-lamps.

While the preferred embodiments have been illustrated and described hereinbefore it is to be particularly understood that the invention is not limited thereto or thereby.

I claim as my invention:

1. A combination connection for mechanically supporting and electrically connecting a coiled elongated incandescible filament principally comprising tantalum carbide to a main filament support and electrical connection means, said connection comprising:

a. a relatively thick elongated member principally comprising tantalum carbide;

b. a coiled end extension of said elongated filament coil snugly overfitting at least a part of said relatively thick elongated member, the inner surface of the overfitted turns of said end extension coil welded to said relatively thick elongated member; and c. said relatively thick elongated member electrically connected to and mechanically supported by said main filament support and electrical connection means.

2. The combination as specified in claim 1, wherein said coiled elongated filament has two end extension portions, two of said relatively thick elongated members provide electrical connection and mechanical support for said filament, each said end extension portion of said elongated filament snugly overfits at least a part of a different one of said relatively thick elongated members, and both of said relatively thick elongated members are electrically connected to and mechanically supported by said main filament support and electrical connection means.

3. The combination as specified in claim 1, wherein electrical connection and mechanical support between said relatively thick elongated member and said main filament support and electrical connection means is made by a rigid metal means principally comprising tantalum, and the connection between said relatively thick elongated member and said rigid metal means is a tight mechanical fit connection.

4. The combination as specified in claim 1, wherein said coil and said relatively thick elongated member are formed of tantalum carbide or an alloy of tantalum-tungsten carbide wherein the ratio by weight of tantalum to tungsten is 90:10.

5. The combination as specified in claim 1, wherein there is additionally provided a sealed envelope means which is at least partially radiation transmitting and in which said coiled filament is mounted, said envelope means encloses an atmosphere suitable for operation of said coiled filament, and said main filament support and electrical connection means comprises a supporting frame rigidly affixed within said envelope means.

6. The combination as specifed in claim 5, wherein said coiled filament is formed as a plurality of separate filament coils each connected to one another by an uncoiled filament section, and said uncoiled filament sections are supported to provide additional support for said filament.

* * * * *